United States Patent [19]

Hodgson

[11] 4,448,310

[45] May 15, 1984

[54] DISPLAY PACKAGE OF PAGE-MARKERS

[75] Inventor: Dale A. Hodgson, Summersville, W. Va.

[73] Assignee: Bright of America, Summersville, W. Va.

[21] Appl. No.: 464,413

[22] Filed: Feb. 7, 1983

[51] Int. Cl.[3] ..... B65D 85/62; B65D 83/00

[52] U.S. Cl. ..... 206/526; 206/820; 116/234

[58] Field of Search ..... 206/526, 527, 349, 39, 206/820, 554; 116/234

[56] References Cited

U.S. PATENT DOCUMENTS

| | | | |
|---|---|---|---|
| 1,803,602 | 5/1931 | Dey | 206/820 |
| 2,116,147 | 5/1938 | Haessler | 116/234 |
| 2,582,785 | 1/1952 | Luppold | 206/449 |
| 3,145,839 | 8/1964 | Lowry | 206/554 |
| 3,757,936 | 9/1973 | Lindegren | 206/527 |
| 4,358,012 | 11/1982 | Marsala et al. | 206/39 |

*Primary Examiner*—William T. Dixson, Jr.

*Attorney, Agent, or Firm*—Diller, Ramik & Wight

[57] ABSTRACT

This disclosure relates to a package for the display, sale and eventual use of page-markers which is formed of a sheet of paperstock material of a generally polygonal configuration defined by a pair of generally parallel spaced side edges and generally parallel spaced top and bottom edges with at least two lines of weakening disposed generally normal to each other, a first of lines of weakening being spaced below and in parallel relationship to the top edge, the second of the lines of weakening being spaced inboard and parallel to the side edges and extending between the first line of weakness and the bottom edge and defining therewith at least a pair of page markers joined to each other along the second line of weakening, each of the pair of page markers having a U-shaped cut line opening toward the first weakening line to define a page-engaging tab, and means in the form of an opening between the top edge and the first weakening line for thereby suspending the package for display purposes.

3 Claims, 4 Drawing Figures

FIG.1
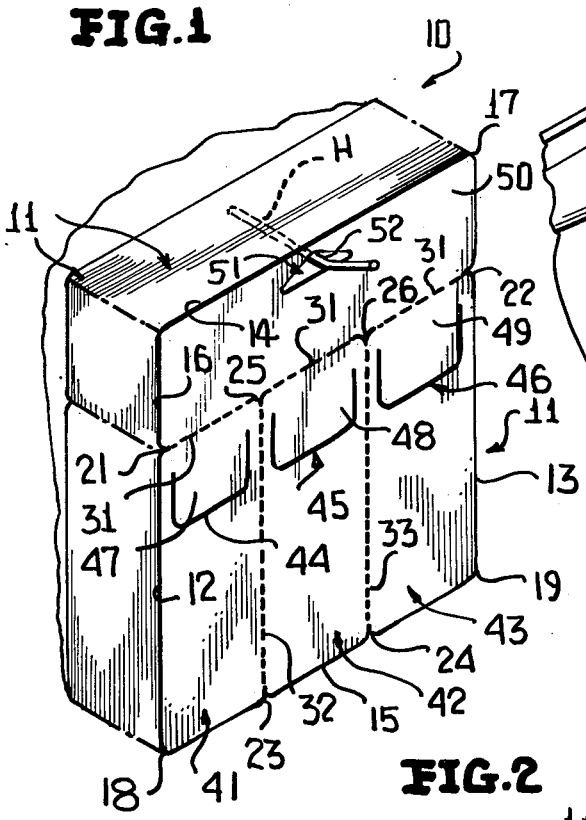
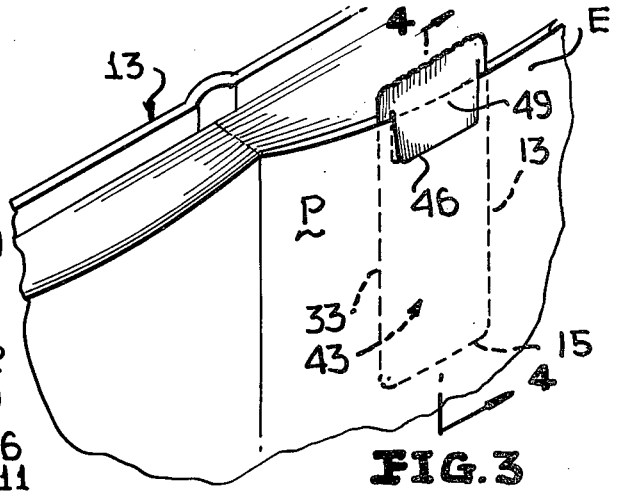
FIG.3
FIG.4
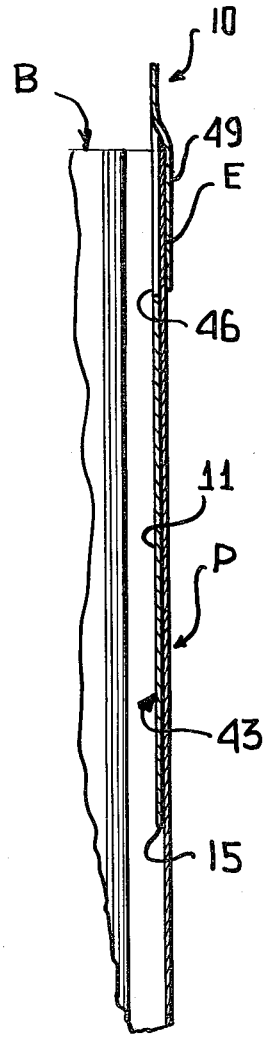
FIG.2
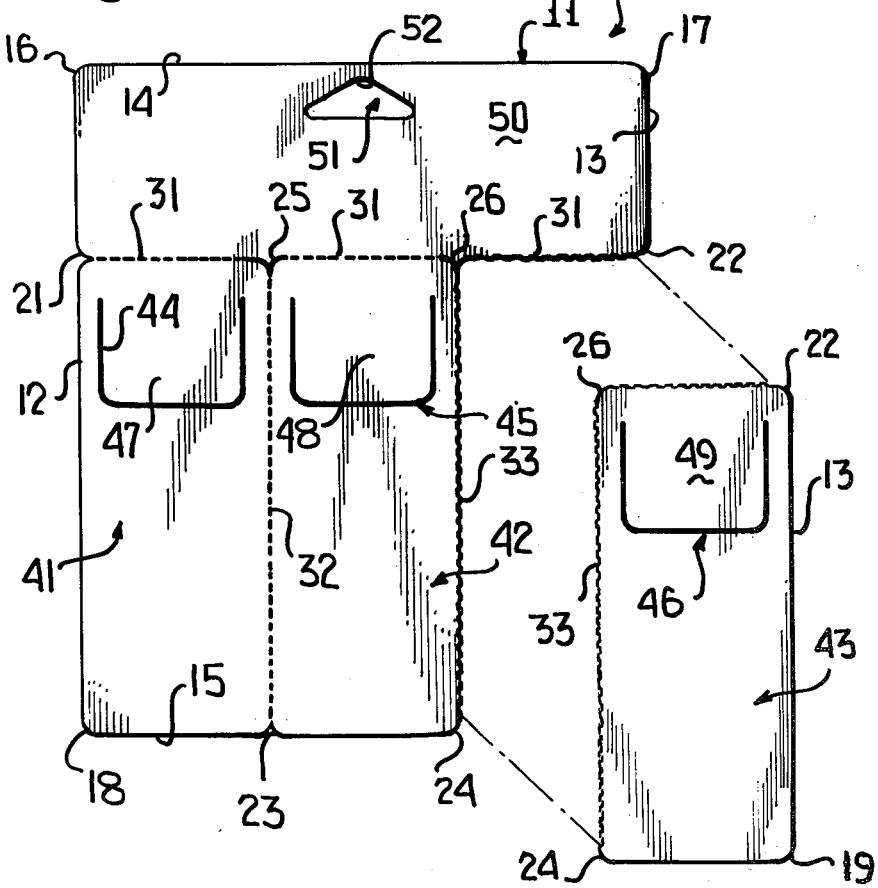

DISPLAY PACKAGE OF PAGE-MARKERS

A bookmark, bookmarker or page-marker is generally used by a person for subsequently finding a place in a book, magazine, pamphlet or the like. Conventional paperclips, small pieces of paper and the like are conventionally utilized for this purpose as are more sophisticated and costly bookmarkers.

The present invention is directed to a novel bookmarker or page-marker of extremely simple, yet effective, construction which is packaged in a novel manner for ease of display and rapid eventual use. In accordance with the present invention, a package is formed from a sheet of polygonally configured paperstock material having generally parallel spaced side edges and generally parallel spaced top and bottom edges with a plurality of weakening lines setting-off at least two but preferably three bookmarks, and each of the bookmarks having a generally U-shaped cut line which functions when the individual bookmarks are removed from the sheet to be slipped upon a book page edge to mark that particular page.

In further accordance with this invention, the novel package of bookmarks includes an opening in a header or header portion of the sheet which can be utilized to suspend the package from an appropriate display hanger.

Yet another object of this invention is a novel package of bookmarkers in which the weakening lines are defined by at least one line of weakening spaced from and parallel to the upper edge, and two other weakening lines parallel to each other and to the side edges disposed between the first weakening line and the bottom edge to set off therebetween at least three bookmarkers.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a perspective view of a display package for bookmarkers, and illustrates a plurality of generally polygonally configured sheets of paperstock material, each of which has lines of weakening and generally U-shaped cut liens defining three bookmarkers.

FIG. 2 is a perspective view, slightly enlarged of one of the packages or sheets of FIG. 1, and illustrates one of the bookmarkers torn therefrom for subsequent use with an associated book.

FIG. 3 is a fragmentary perspective view of a book, and illustrates the removed bookmarker of FIG. 3 in its position of use marking a page in the book.

FIG. 4 is a fragmentary enlarged sectional view taken generally along line 4—4 of FIG. 3, and discloses more specifically the operative position of the bookmarker.

A novel package constructed in accordance with this invention is generally designated by the reference numeral 10 and is designed specifically for the display, sale and eventual use of bookmarkers, bookmarks or page-markers, and includes a plurality of identical sheets of paperstock material with one of the sheets being designated by the reference numeral 11. The sheet 11 of paperstock material is of a polygonal configuration and is defined by a pair of generally parallel, spaced side edges 12, 13 and generally parallel, spaced top and bottom edges 14, 15, respectively.

Each sheet 11 includes four rounded edges or corners 16 through 19. The side edges 12, 13 include opposing notches 21, 22 whereas the bottom edge 15 includes a pair of upwardly directed notches 23, 24 facing opposing downwardly directed slits or notches 25, 26, respectively.

Three lines of weakening 31, 32 and 33 are formed in each sheet 11 as lines of scoring or lines of perforation. The weakening line 31 is parallel to the edge 14 in line with the notches or slots 21, 22, and extends between the edges 12, 13 while blending with the notches 25, 26. The weakening lines 32, 33 are in parallel spaced relationship to each other and to the edges 12, 13. The lines of weakening 32, 33 extend between the respective notches 23, 25 and 24. 26.

The lines of weakening 31 through 33, portions of the edges 12, 13 and the bottom edge 15 define three bookmarks, bookmarkers or page-markers 41, 42, and 43. Ech of the bookmarkers 41 through 43 includes a respective upwardly opening generally U-shaped cut line 44 through 46 which in turn defines a page-engaging or page-overlapping tab 47 through 49, respectively.

An uppermost rectangular area 50 of each sheet 11 is the "header" area of the package 10 upon which appropriate indicia might be placed as, for example, the tradename of the manufacturer, the trademark of the product, addresses and/or phone numbers, etc. Headers of this type generally are used for advertising the product or products disposed or located beneath the weakening line 31. The header 50 is defined by the upper edge 14, portions of the side edges 12, 13, and the weakening line 31. This header is provided with means, generally designated by the reference numeral 51, in the form of a triangular-shaped opening having an upper apex 52 which receives a hook H from which the package 10 can be hung in the manner best illustrated in FIG. 1.

An individual can select one package 10 or sheet 11 from the plurality of those shown in FIG. 1 by simply withdrawing the same from the hook H and thereafter removing a selected bookmarker by tearing along the selected weakening lines, as indicated by the removed bookmarker 43 in FIG. 2. Thereafter, the bookmarker is positioned upon an upper edge E of a page P of a book B (FIG. 3) in the manner clearly illustrated therein. If the book is closed, obviously, the page is marked and a reader can return thereto with little difficulty.

Although only a preferred embodiment of the invention has been specifically illustrated and described herein, it is to be understood that minor variations may be made in the apparatus without departing from the spirit and scope of the invention, as defined in the appended claims.

What is claimed is:

1. A package for the display, sale and eventual use of page-markers consisting solely of a single sheet of paperstock material of a generally polygonal configuration defined by a pair of generally parallel spaced side edges and generally parallel spaced top and bottom edges, at least two lines of weakening disposed generally normal to each other, a first of said lines of weakening being spaced below and in parallel relationship to said top edge, a second of said liens of weakening being spaced inboard of and parallel to said side edges and extending between said first line of weakening and said bottom edge and defining therewith at least a pair of page-markers joined to each other along said second line of weakening, each said pair of page-markers having a generally U-shaped cut line opening upwardly toward said first weakening line defining a page-engaging tab, and cut-line means between said top edge and said first weakening line and generally centrally of said spaced side edges forming an opening for suspending said package for display purposes.

2. The package as defined in claim 1 including a third weakening line in spaced parallel relationship with said second weakening line and defining therewith a third page-marker, said third weakening line also extending between said first weakening line and said bottom edge, and an U-shaped cut line in said third page-marker opening upwardly toward said first weakening line defining a third page-engaging tab.

3. The package as defined in claim 1 wherein said opening is of a triangular configuration having an upper apex.

* * * * *